US005613485A

United States Patent [19]

Covault

[11] Patent Number: 5,613,485

[45] Date of Patent: Mar. 25, 1997

[54] CAMPSTOVE WITH ADJUSTABLE GRATE

[75] Inventor: Andrew J. Covault, Wichita, Kans.

[73] Assignee: Coleman Taymar Limited, Great Britain

[21] Appl. No.: 377,194

[22] Filed: Jan. 30, 1995

[51] Int. Cl.[6] ..... F24C 5/20

[52] U.S. Cl. ..... 126/38; 126/24; 126/43; 126/50; 431/344

[58] Field of Search ..... 126/50, 30, 24, 126/38, 52, 42, 43, 44; 431/344

[56] References Cited

U.S. PATENT DOCUMENTS

| | | | |
|---|---|---|---|
| 1,343,341 | 6/1920 | Berglam | 126/24 |
| 1,371,407 | 3/1921 | Berglann | 126/24 |
| 3,213,849 | 10/1965 | Hirsch | 126/43 |
| 3,900,281 | 8/1975 | Penberthy | 431/344 |
| 3,907,490 | 9/1975 | Schaller | 126/38 X |
| 4,653,462 | 3/1987 | De Foe | 126/24 |
| 4,759,339 | 7/1988 | Hefling | 126/38 X |
| 5,117,808 | 6/1992 | Peters et al. | 126/38 X |
| 5,425,354 | 6/1995 | Park | 126/38 X |
| 5,513,624 | 5/1996 | Vorhis | 126/38 |

FOREIGN PATENT DOCUMENTS

| | | |
|---|---|---|
| 2262157A | 6/1973 | United Kingdom . |
| 2262156A | 6/1993 | United Kingdom . |

OTHER PUBLICATIONS

MSR Whisper Lite Operating Instructions (no date).
MSR Rapid Fire Instruction Book (no date).
Sports Afield March, 1992 pp. 93–94.
"Light Weight Stoves" published in Off Belay,1973 pp. 6–26.
Operating Instructions for Coleman Model 536 (no date).
Catalog page for Epigas Stoves (no date).
Catalog page for Optimus Stoves (no date).
Catalog page for Esbit/Gaskocker Stoves (no date).
Catalog page for Markill Stoves (no date).
Catalog pages for Camping Gaz Stoves (no date).
Catalog page for Rando and Bleuet Stoves (no date).
Catalog page for Bleuett Stoves (no date).
Catalog page from Kok p. 108–09 (no date).
Japanese catalog page for BPS Stoves (no date).

*Primary Examiner*—Larry Jones

[57] ABSTRACT

A campstove is provided with an adjustable grate legs for supporting a cooking utensil. The grate legs are movable between a compact, storage position and an extended position in which they provide a relatively stable support for a pan or a pot. The campstove includes a base, a fuel tube which extends upwardly from the base, and a burner mounted on the top of the fuel tube. A burner bowl is rotatably mounted on the fuel tube for rotation relative to the base. Each of the grate legs includes a bottom portion which is rotatably mounted in the base, an intermediate portion which extends below the burner bowl away from the axis of rotation of the leg, and a top portion which extends above the bowl toward the axis of rotation. Abutments on the burner bowl are engageable with each of the legs for rotating the legs when the burner bowl is rotated relative to the base. Rotation of the burner bowl in one direction moves the legs to an extended position in which the top portions are positioned relatively far from the burner, and rotation of the burner bowl in the other direction moves the legs to a retracted position in which the top portions are positioned relatively close to the burner.

12 Claims, 5 Drawing Sheets

CAMPSTOVE WITH ADJUSTABLE GRATE

BACKGROUND

This invention relates to campstoves, and, more particularly, to a campstove which is provided with an adjustable grate for supporting a cooking utensil such as a pot or a pan.

Campstoves generally include a burner for burning fuel, a burner bowl which surrounds the burner, and a grate for supporting a pot, pan, or other utensil above the burner. Some campstoves are designed to be relatively compact so that they can be stored in a relatively small space. Compactness is particularly important for stoves which are used by backpackers because a backpack has only a limited amount of space. However, a grate generally interferes with the objective of compactness because a grate must extend outwardly from the burner to provide a stable support for pots or pans.

Some grates are removable so that the stove can be stored more compactly. However, a removable grate must also be stored and creates additional bulk. Further, parts which separate can be lost, and disassembling and assembling parts can be difficult in extreme weather or low light conditions.

SUMMARY OF THE INVENTION

The invention provides an adjustable grate which is movable between an extended or support position and a retracted or storage position. The grate is adjusted simply by rotating the burner bowl of the stove relative to the base of the stove. The burner bowl is rotatably mounted on a fuel tube which extends upwardly from the base. The grate is formed from a plurality of legs. Each leg includes a bottom portion which is rotatably mounted in the base for rotation about an axis which is parallel to, but spaced from, the axis of the fuel tube, an intermediate portion which extends below the burner bowl away from the axis of rotation, and a top portion which extends above the burner bowl toward the axis of rotation. The intermediate portion of each leg is straddled by a pair of tabs on the burner bowl which rotate the legs as the burner bowl rotates. When the burner bowl is rotated in one direction, the top portions of the legs move outwardly away from the fuel tube to the extended position. When the burner bowl is rotated in the other direction, the top portions of the legs move toward the fuel tube to the retracted position.

DESCRIPTION OF THE DRAWINGS

The invention will be explained in conjunction with an illustrative embodiment shown in the accompanying drawings, in which.

DESCRIPTION OF SPECIFIC EMBODIMENT

Figure 1:
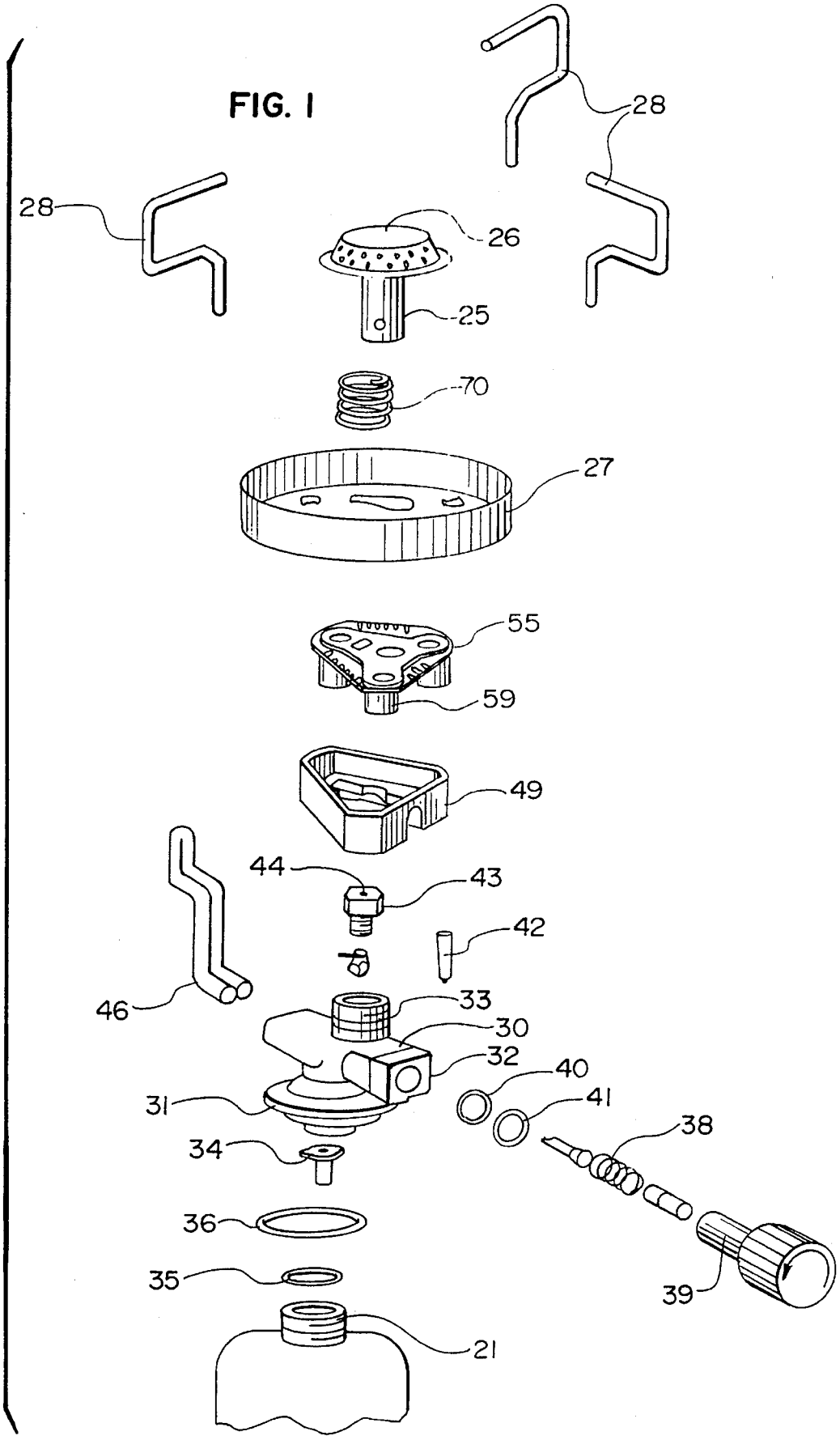
FIG. 1 is an exploded fragmentary perspective view of a campstove formed in accordance with the invention and a fuel tank.
Figure 2:
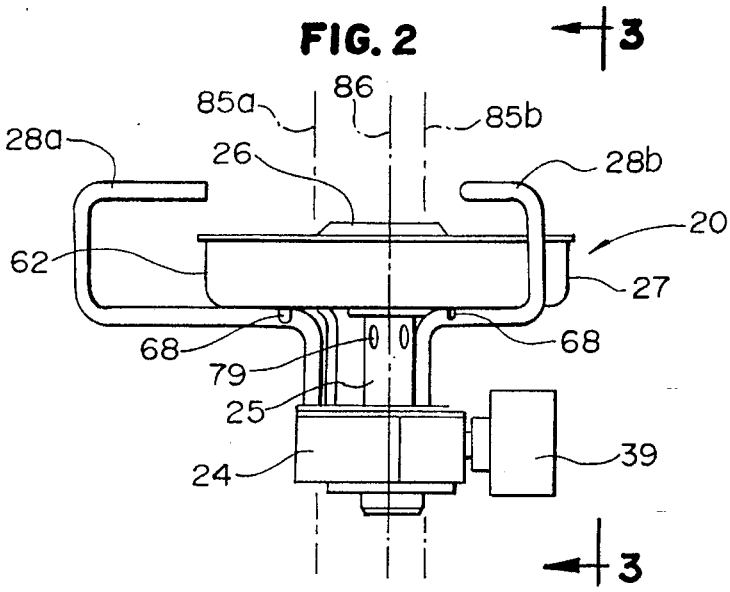
FIG. 2 is a side elevational view of the campstove.
Figure 3:
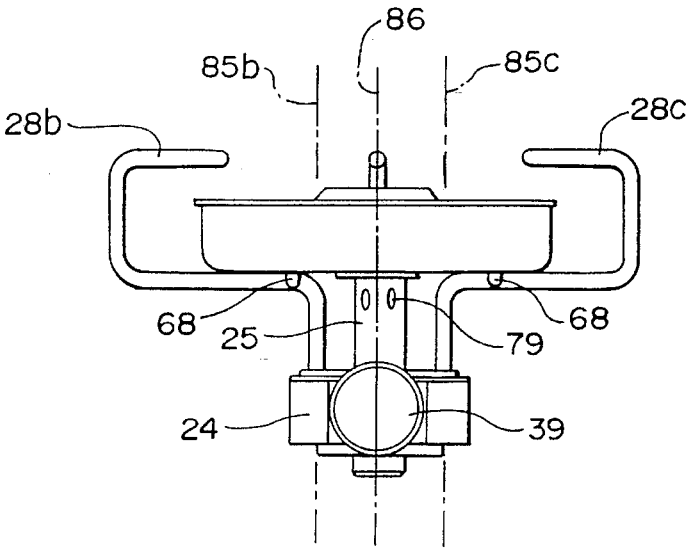
FIG. 3 is a side elevational view of the campstove taken along the line 3—3 of FIG. 2.
Figure 4:
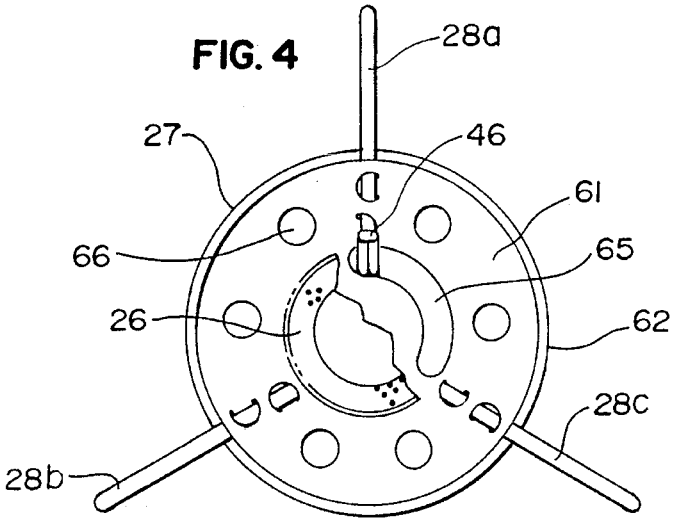
FIG. 4 is a top plan view, partially broken away, of the campstove.

The numeral 20 designates generally a campstove which is designed to burn liquefied petroleum gas (LPG) such as propane, butane, isobutane, and mixtures thereof. However, the invention can also be used on campstoves which burn liquid fuel such as white gas, unleaded gasoline, or the like. The particular campstove illustrated is adapted to screw onto the conventional outlet bushing 21 of a disposable tank 22 of LPG fuel so that the campstove is supported by the upright fuel tank. Such connections between campstoves and disposable fuel tanks are well known and need not be described herein.

The campstove 20 includes a base 24 which is connectable to the fuel tank. If the campstove is designed to burn liquid fuel the base can be modified to be supported by the ground. A rigid metal fuel tube 25 is connected to the base and extends upwardly therefrom, a burner 26 is mounted on the top of the fuel tube, and a burner bowl or windscreen 27 is rotatably mounted on the fuel tube. Three grate legs 28 are rotatably mounted in the base. As will be explained more fully hereinafter, the grate legs are movable between an extended support position illustrated in FIGS. 2–6 in which the legs can support a pot, pan, or other utensil and a retracted storage position illustrated in FIG. 7.

Referring to FIG. 1, the base includes a valve housing 30 which includes a bottom connector bushing 31, a valve bushing 32, and a top fuel outlet bushing 33. The connector bushing 31 is adapted to be screwed onto the outlet bushing 21 of the fuel tank 22.

A valve stem 34 is mounted in the connector bushing for engaging and opening the valve of the fuel tank. A small O-ring 35 surrounds the valve stem, and a large O-ring 36 surrounds the connector bushing. The O-rings sealingly engage the outlet bushing of the fuel tank.

A needle valve 38 is threadedly engaged with the valve bushing 32 and is rotated by a control knob 39. O-rings 40 and 41 provide a seal between the needle valve and the valve bushing. The needle valve is engageable with a valve seat inside of the valve housing for shutting off a fuel passage between the valve stem 34 and the fuel outlet bushing 33. Flow of fuel through the fuel passage is controlled by backing the needle valve away from the valve seat. A pin 42 is inserted into the housing and is engageable with the needle valve 38 to prevent the needle valve from being backed out too far.

A fuel outlet fitting 43 is threaded into the fuel outlet bushing 33 and is provided with a fuel orifice 44 through which fuel is injected into the fuel tube 25. The outlet bushing is externally threaded to provide a screw connection to the fuel tube.

A generator tube 46 is operably connected to the fuel valve and serves as a conduit for carrying fuel from the valve to a location adjacent the burner. The upper portion of the generator passes through the burner flame zone to vaporize any liquid fuel present in the generator and thereby minimize flare at the burner.

Figure 16:
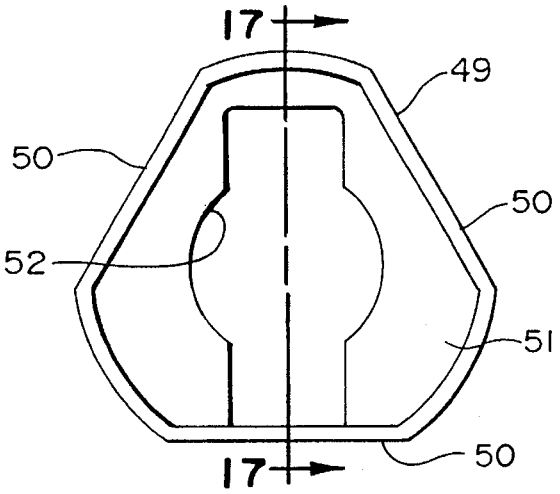
FIG. 16 is a top plan view of the cover of the base.
Figure 17:
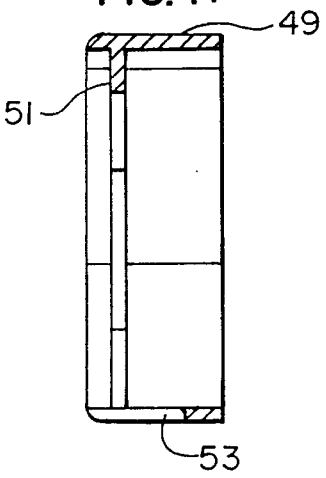
FIG. 17 is a sectional view of the cover taken along the line 17—17 of FIG. 16.
Figure 18:
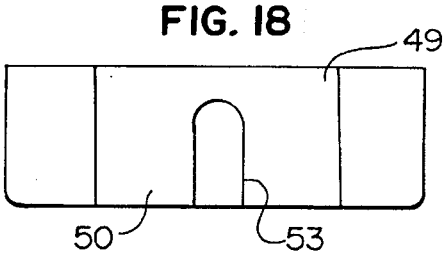
FIG. 18 is a side elevational view of the cover taken along the line 18—18 of FIG. 16.

The valve housing 30 is positioned within a generally triangular cover 49 (see also FIGS. 16–18). The cover is provided with three straight side walls 50 and a bottom wall 51. A keyhole-shaped opening 52 is provided in the bottom wall through which the connector bushing 31 and valve stem 34 extend. A slot 53 is provided in one of the side walls 50 for the needle valve 38.

Figure 14:
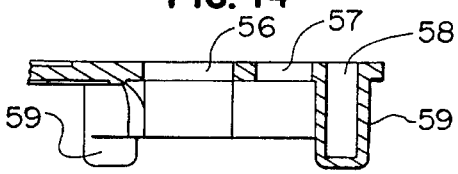
FIG. 14 is a sectional view taken along the line 14–14 of FIG. 13.
Figure 13:
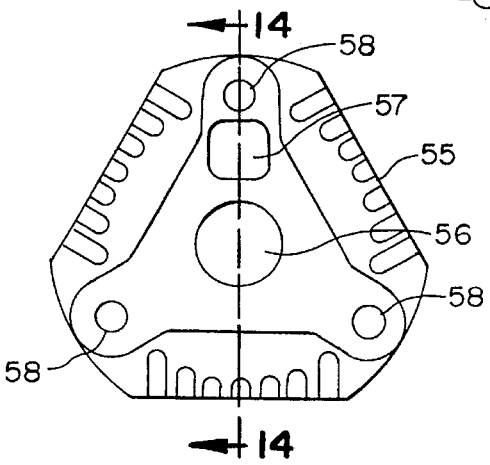
FIG. 13 is a plan view of the chassis of the base.
Figure 15:
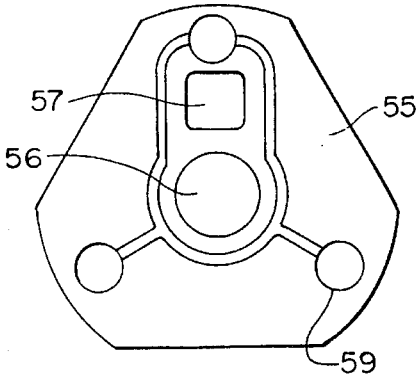
FIG. 15 is a bottom plan view of the chassis.

A chassis 55 (FIGS. 2 and 13–15) closes the top of the cover 49 and encloses the valve housing. The chassis is provided with a central opening 56 through which the threaded fuel outlet bushing 33 extends, an opening 57 through which the generator 46 extends, and three openings 58 for rotatably receiving the grate legs 28. A socket 59 (FIG. 14) extends below each of the openings 58.

Figure 8:
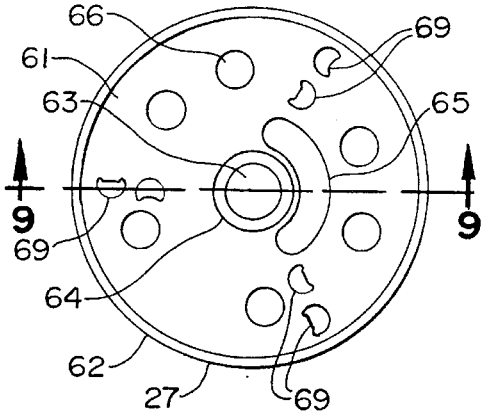
FIG. 8 is a top plan view of the burner bowl.
Figure 9:
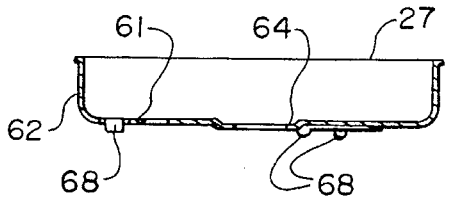
FIG. 9 is a sectional view of the burner bowl taken along the line 9—9 of FIG. 8.

Referring to FIGS. 8 and 9, the burner bowl 27 includes a generally flat bottom wall 61 and a generally cylindrical side wall 62 which extends upwardly from the bottom wall. A central opening 63 is provided in the bottom wall through which the fuel tube 25 extends. An annular depression 64 in the bottom wall surrounds the central opening. The generator 46 extends through an arcuate slot 65 in the bottom wall, and the bottom wall is also provided with a plurality of air holes 66.

Figure 10:
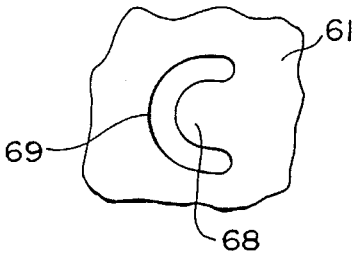
FIG. 10 is a fragmentary top plan view of the burner bowl showing one of the tabs for the grate legs before the tab is bent downwardly.
Figure 11:
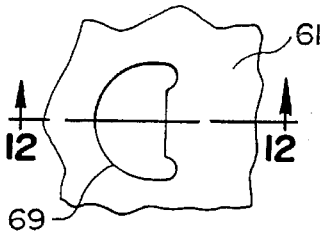
FIG. 11 is a view similar to FIG. 10 showing the tab bent downwardly.
Figure 12:
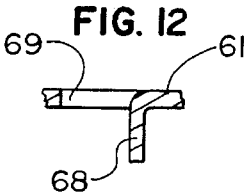
FIG. 12 is a fragmentary sectional view taken along the line 12—12 of FIG. 11.

Referring to FIG. 10, a plurality of tabs 68 are formed in the bottom wall by stamping C-shaped slots 69 in the bottom wall, and the tabs 68 are thereafter bent downwardly as illustrated in FIGS. 11 and 12. A pair of tabs 68 are provided for each of the grate legs 28 so that the tabs straddle the grate leg, and the grate leg is confined between the tabs.

The burner 26 extends radially outwardly from the fuel tube 25 (FIGS. 1 and 5), and a coil spring 70 (FIG. 1) surrounds the fuel tube 25 and is compressed between the burner head 26 and the annular depression 64 in the center of the burner bowl. The bottom wall of the burner is advantageously permanently connected to the fuel tube.

Figure 5:
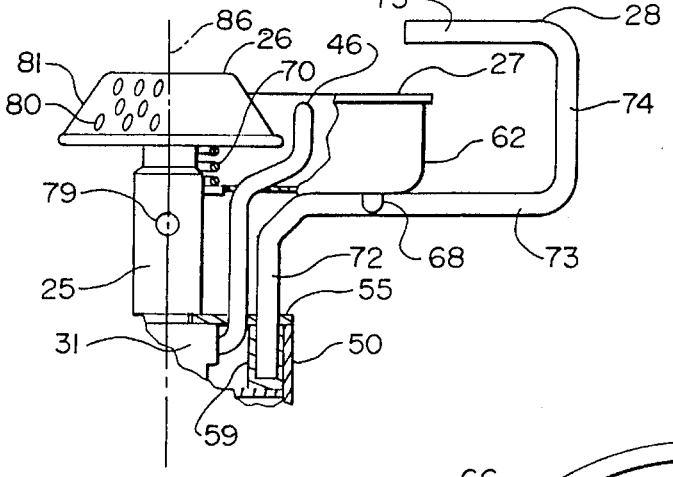
FIG. 5 is a fragmentary sectional view of the campstove.
Figure 19:
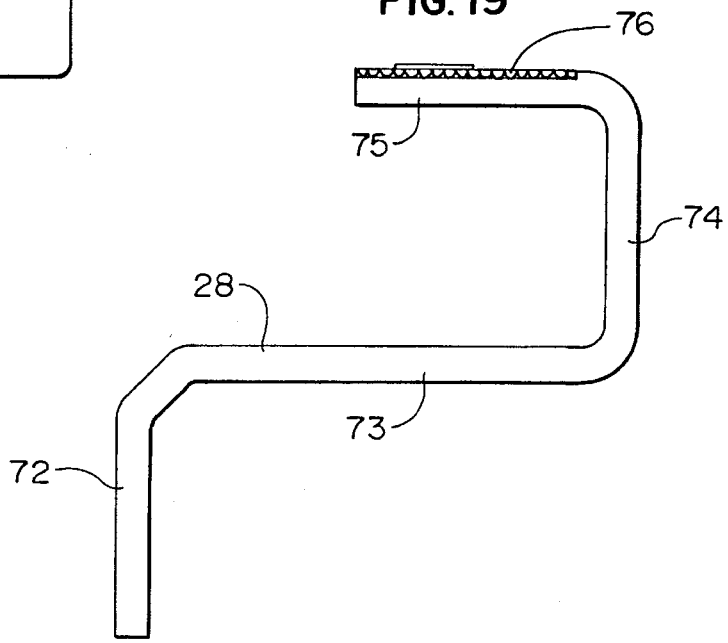
FIG. 19 is a side elevational view of one of the grate legs.

Referring to FIG. 5, each of the grate legs 28 includes a bottom portion 72 which is rotatably mounted in one of the sockets 59 of the chassis 55 and which extends parallel to, but offset from, the axis of the fuel tube 25. An intermediate portion of the grate leg 73 extends outwardly below the bottom of the burner bowl 27 and is positioned between a pair of adjacent tabs 68 on the burner bowl. An outer portion 74 of the grate leg extends upwardly generally parallel to the bottom portion 72 and the axis of rotation thereof. A top portion 75 is spaced upwardly from the burner bowl and extends inwardly toward the axis of rotation of the bottom portion 72. The top portions 75 of the grate legs are intended to support a pot, pan, or other utensil. Referring to FIG. 19, the upper surface of the top portion 75 can be provided with knurling 76 to increase frictional contact between the grate legs and the utensil.

The campstove is assembled by inserting a grate leg 28 into each of the sockets 59 in the chassis 55 of the base. The fuel tube 25 is then inserted through the coil spring 70 and through the central opening 63 of the burner bowl 27 and is screwed onto the threaded fuel outlet bushing 33 of the valve housing. After the fuel tube 25 is connected to the fuel outlet bushing 33, the coil spring 70 is compressed between the burner head 26 and the burner bowl 27 and resiliently forces the burner bowl 27 against the intermediate portions 73 of the grate legs. The burner bowl can be pushed upwardly by compressing the coil spring 70 to permit each of the grate legs to be positioned between a pair of the tabs 68 which extend downwardly from the burner bowl.

The fuel tube 25 is provided with a plurality of air openings 79 through which ambient air is aspirated into the fuel which flows upwardly through the fuel tube 25. The fuel/air mixture flows into the burner 26 and outwardly through a plurality of openings 80 which are provided in the frusto-conical side wall 81 of the burner. The campstove is lighted by holding a lighted match near the burner 26 and opening the fuel valve by turning the fuel control knob 39. The fuel/air mixture is ignited outside of the burner and heats the cooking utensil which is supported by the grate legs 28.

Figure 6:
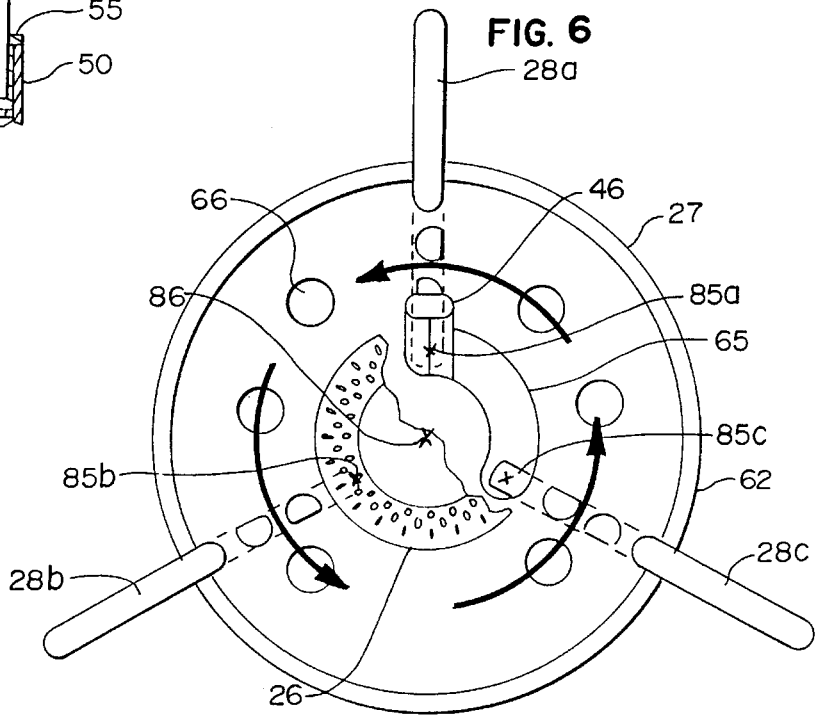
FIG. 6 is a top plan view, partially broken away, of the campstove showing the grate in the extended support position.

FIG. 6 illustrates the grate legs in their extended support position. The grate leg **28*a* is rotatably mounted in the base 24 for rotation about an axis 85*a* which is axially aligned with the bottom portion 72 of the leg (see also FIG. 2). Similarly, the grate legs 28*b* and 28*c* are rotatable about axes 85*b* and 85*c* which are axially aligned with the bottom portions of those legs (see also FIGS. 2 and 3). The burner bowl 27 is rotatably mounted on the fuel tube 25 for rotation about an axis 86 (see also FIG. 2 and 3) which corresponds to the longitudinal axis of the fuel tube 25**.

Figure 7:
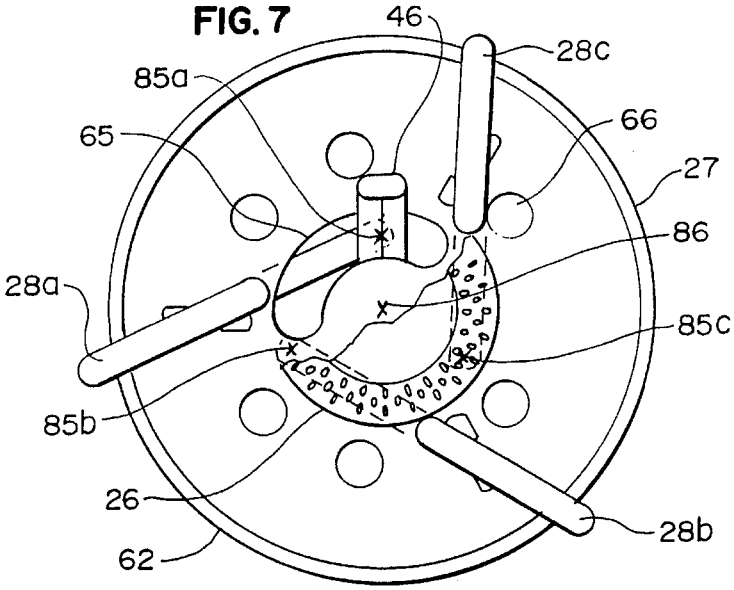
FIG. 7 is a view similar to FIG. 6 showing the grate in the retracted storage position.

In FIG. 6 the top portion 75 of each leg is aligned with or points toward the axis 86 of the fuel tube, and the outer end of each top portion is positioned in its farthest position from the burner 26 and the side wall 62 of the burner bowl 27. However, when the burner bowl is rotated clockwise relative to the fuel tube 25 and the base 24 in the directions of the arrows, the distance between the outer end of each top portion 75 and the burner and burner bowl will decrease because the axes of rotation of the legs are offset from the axis of rotation of the burner bowl. As the burner bowl is rotated, the grate legs **28*a–c* rotate about their pivot axes 85*a–c* because of the engagement between the tabs 86 and the intermediate portions of the legs. The leg 28*a* will be rotated about its axis 85*a* from the 12 o'clock position illustrated in FIG. 6 to a position at about 8 o'clock as illustrated in FIG. 7. Similarly, the leg 28*b* will be rotated about its axis 85*b* from the 7:30 o'clock position illustrated in FIG. 6 to about the 5 o'clock position illustrated in FIG. 7, and the leg 28*c* will be rotated about its axis 85*c* from the 4:30 o'clock position illustrated in FIG. 6 to the 1 o'clock position illustrated in FIG. 7. As the grate legs rotate counterclockwise, the upper portions 75 move closer to the center of the burner, and the outer portions 74 move into engagement with the cylindrical side wall 62 of the burner bowl. In their retracted positions illustrated in FIG. 7**, the grate legs are positioned adjacent the periphery of the burner bowl, and the campstove thereby assumes a compact configuration which can be easily stored in a backpack or other storage or transporting device. In addition in the compact or collapsed configuration, the stove is capable of supporting smaller utensils, such as metal cups.

When the burner bowl 27 is rotated clockwise from its FIG. 7 position, the tabs 68 will cause the legs to rotate about their rotational axes back to the extended support position illustrated in FIG. 6. As each grate leg pivots about its axis, the outer portion 74 and top portion 75 thereof move outwardly relative to the burner bowl and the burner. Rotation of the burner bowl is accomplished simply by grasping the burner bowl in one hand and the base 24 or fuel tank in the other hand and rotating one relative to the other.

Each of the grate legs is engageable by a pair of abutment tabs 68 which extend downwardly from the bottom of the burner bowl. One of the tabs engages the leg when the burner bowl is rotated in one direction, and the other tab engages the leg when the burner bowl is rotated in the other direction. When the burner bowl reaches its FIG. 6 position in which the legs are fully extended, each leg is engaged by both of the abutment tabs, and further clockwise rotation of the burner bowl is thereby prevented.

The arcuate slot 65 in the bottom of the burner bowl permits the burner bowl to be rotated relative to the thermocouple sensor 46 without interference from the sensor.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A campstove comprising:

a burner bowl having top and bottom surfaces, a burner mounted within the burner bowl above the top surface, a base rotatably connected to the burner bowl below the bottom surface, a plurality of grate legs, each of the legs including a bottom portion which is rotatably mounted in the base, an intermediate portion which extends along the bottom surface of the burner bowl away from the axis of rotation of the leg and a top portion which extends above the top surface of the burner bowl toward the axis of rotation of the leg, and abutment means on the burner bowl for each of the legs which is engageable with the intermediate portion of the leg whereby rotation of the burner bowl relative to the base in one direction causes legs to rotate relative to the base and causes the top portions of the legs to move away from the burner and rotation of the burner bowl relative to the base in the opposite direction causes the top portions of the legs to move closer to the burner.

2. The campstove of claim 1 in which said abutment means includes a pair of stop members on the burner bowl for each of the grate legs, the stop members of each pair extending downwardly from the bottom surface of the burner bowl and straddling one of the legs.

3. The campstove of claim 2 in which each of the stop members comprises a tab which is formed from the bottom surface of the burner bowl and is bent downwardly therefrom.

4. The campstove of claim 1 in which the axes of rotation of the bottom portions of the grate legs extend parallel to the axis of rotation of the burner bowl relative to the base.

5. The campstove of claim 1 including a tube extending between the burner and the base, the burner bowl having an opening through which the tube extends, the burner bowl being rotatably mounted on the tube.

6. The campstove of claim 5 in which the tube is a fuel tube for conveying fuel from the base to the burner.

7. The campstove of claim 6 in which the base includes means for connecting the base to a source of fuel.

8. The campstove of claim 6 in which the axes of rotation of the bottom portions of the grate legs extend parallel to the axis of rotation of the burner bowl relative to the base.

9. A campstove comprising:

a base having a top surface and a bottom surface, a tube connected to the top of the base and extending upwardly therefrom, a burner bowl rotatably mounted on the tube, the burner bowl having a bottom wall and a generally cylindrical side wall, the bottom wall having an opening through which the tube extends, a burner mounted on the tube above the bottom wall of the burner bowl, a plurality of grate legs, each of the legs including a bottom portion which is rotatably mounted in the base for rotation about an axis which is parallel to the axis of the tube, an intermediate portion which extends below the bottom wall of the burner bowl away from the axis of rotation of the leg, an outer portion which extends upwardly from the intermediate portion, and a top portion which extends above the side wall of the burner bowl toward the axis of rotation of the leg, and abutments means on the burner bowl for each of the legs which is engageable with the intermediate portion of the leg whereby rotation of the burner bowl relative to the base in one direction causes the legs to rotate relative to the base and causes the outer portions of the legs to move outwardly from the side wall of the burner bowl and rotation of the burner bowl relative to the base in the opposite direction causes the outer portions of the legs to move closer to the side wall of the burner bowl.

10. The campstove of claim 10 in which the grate legs are movable between a first position in which the top portion of each of the legs is positioned relatively far from the tube and extends toward the axis of the tube and a second position in which the top portion of each of the legs is positioned relatively close to the tube and does not extend toward the axis of the tube.

11. The campstove of claim 10 in which the tube is a fuel tube for conveying fuel from the base to the burner.

12. The campstove of claim 11 in which the base includes means for connecting the base to a source of fuel.

* * * * *